United States Patent [19]

Schmitz et al.

[11] 4,190,382

[45] Feb. 26, 1980

[54] SEPARABLE TRENCHING APPARATUS

[75] Inventors: Thomas R. Schmitz, League City; Avadhesh N. L. Srivastav, Houston; Joe C. Lochridge, Houston; William A. Morgan, Houston, all of Tex.

[73] Assignee: Brown & Root, Inc., Houston, Tex.

[21] Appl. No.: 884,987

[22] Filed: Mar. 9, 1978

[51] Int. Cl.[2] ..... E02F 5/02

[52] U.S. Cl. ..... 405/159; 405/163; 405/164

[58] Field of Search ..... 61/69 R, 69 A, 63, 72.4, 61/105, 107, 110; 114/16 R, 16 E

[56] References Cited

U.S. PATENT DOCUMENTS

| | | | |
|---|---|---|---|
| 3,952,532 | 4/1976 | Spearman | 61/72.4 |
| 3,990,377 | 11/1976 | Marquinez | 61/72.4 X |
| 4,037,422 | 7/1977 | DeBoer | 61/72.4 |

*Primary Examiner*—Dennis L. Taylor

*Attorney, Agent, or Firm*—Kenway & Jenney

[57] ABSTRACT

A method and apparatus for entrenching an elongated pipeline and the like uses a trenching apparatus having a trench cutting assembly which is detachably connected to a sled base. A floating vessel has means to control positioning of the trenching apparatus, including means to raise and lower, and to connect and disconnect, the trench cutting assembly and the sled base. Several methods and apparatus are disclosed for raising and lowering the trench cutting assembly while leaving the sled base positioned on the bottom of the body of water, straddling the elongated pipeline. In each embodiment, the cutting means may be lifted on board the vessel for maintenance and/or repair, leaving the sled base in position relative to the pipeline. Means are provided for abandoning the sled base at the entrenching site and returning later to lower the trench cutting assembly into its operational relationship with the sled base.

39 Claims, 31 Drawing Figures

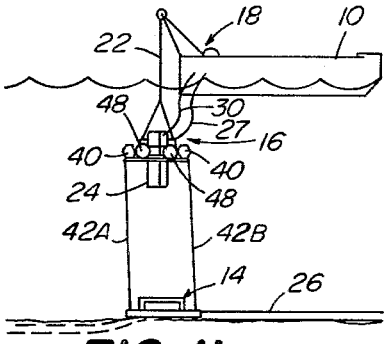
FIG. IL
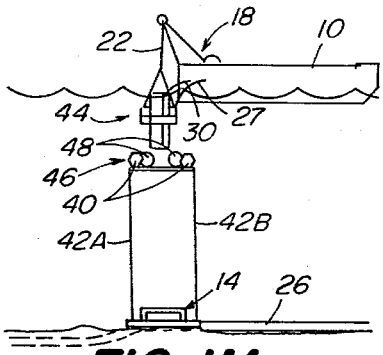
FIG. IM
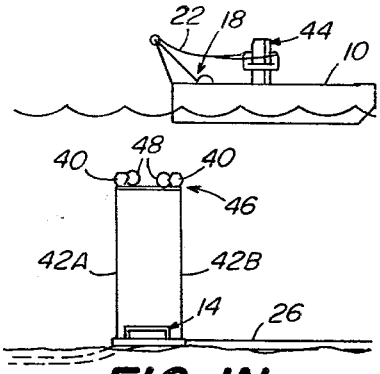
FIG. IN
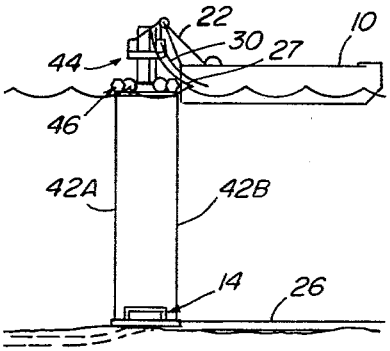
FIG. IP
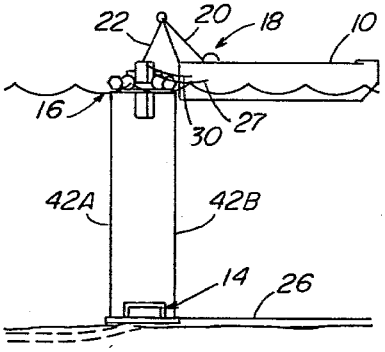
FIG. IQ
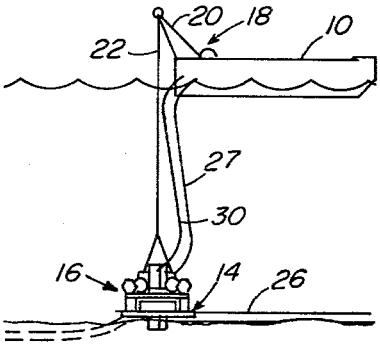
FIG. IR
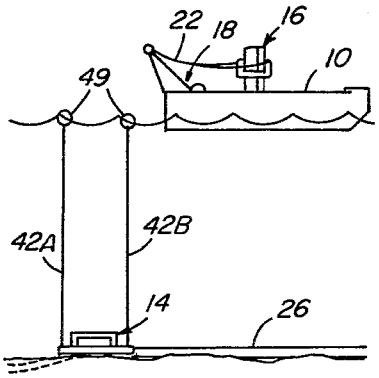
FIG. IS

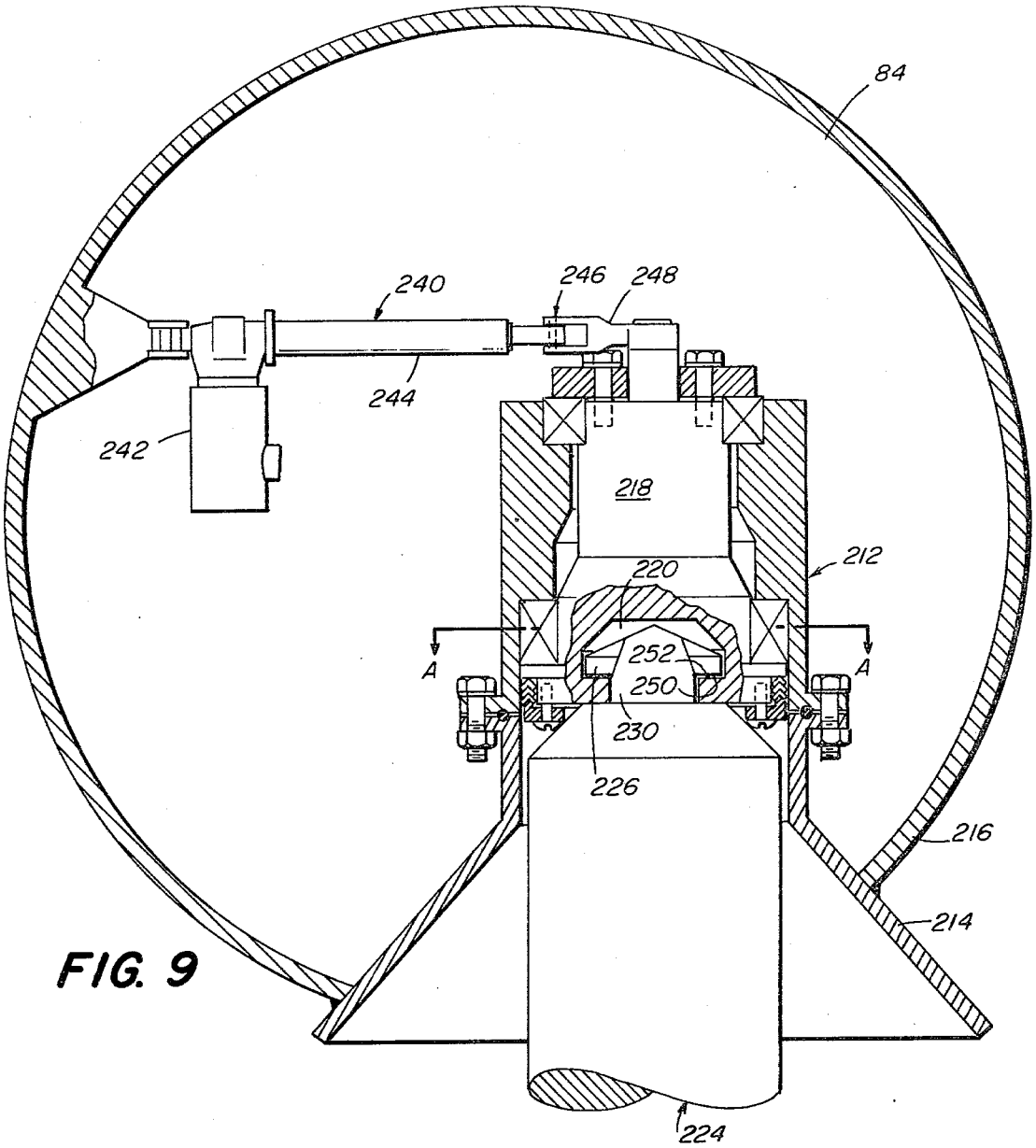
FIG. 9
FIG. 10A
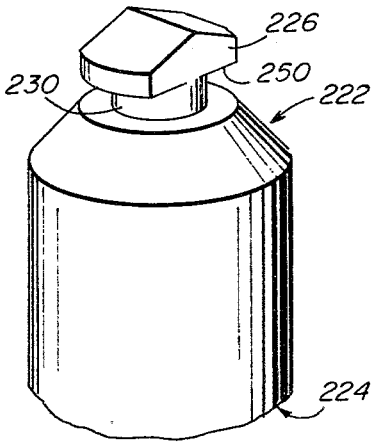
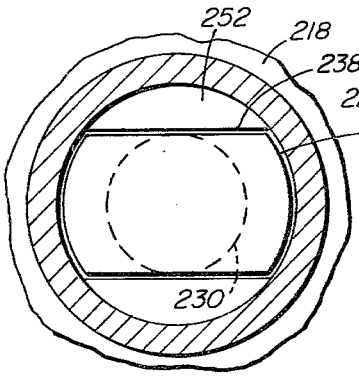
FIG. 10B
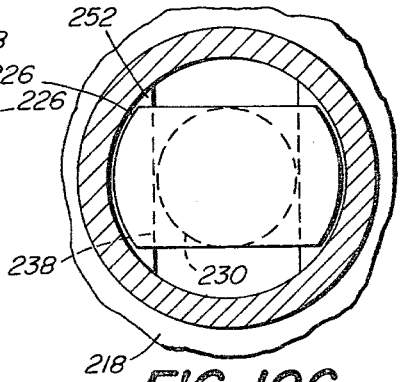
FIG. 10C

SEPARABLE TRENCHING APPARATUS

The invention relates generally to an apparatus for and method of trenching beneath an elongated member lying on the bottom of a body of water and in particular to an apparatus for and method of cutting, using water at high velocity and pressure, a trench beneath an elongated pipeline member lying on the bottom of a body of water.

BACKGROUND OF THE INVENTION

Offshore oil production and storage facilities are typically linked to onshore facilities by at least one pipeline which has been laid along the bottom of a body of water. Large diameter underwater pipelines may also be required to provide a fluid connection between locations on opposite sides of a body of water, for example, a river, or between two points within an open body of water, such as an ocean.

There are many methods and apparatus available for laying a pipeline underwater. Once laid, the pipeline in many instances can remain in an exposed condition on the water bottom. In other instances, however, for example when the water body has significant boat traffic or other human activity, or when the pipeline may be or is subjected to strong currents or other disruptive underwater forces, it is desirable, if not necessary, to protect the pipeline by burying or entrenching it beneath the body of water. Several methods for accomplishing this are well known in the art.

This invention refers to that method in which a burying sled having a water jet cutting means is pulled or towed along the pipeline. As used herein, the term "burying" is meant to refer both to trenching beneath the pipeline, and to trenching beneath the pipeline and then filling in the resulting pipeline filled trench. The sled and in particular the cutting means straddle the pipeline and cut a trench beneath the pipeline as the burying sled is towed forward. As the trench is cut, the pipeline falls into it and is thus safely situated at a level below the water bottom. The trench may thereafter be filled in. Consequently, the pipeline, safe in its protected environment beneath the water bottom, is relatively unaffected by either water traffic or water forces which might otherwise have had an adverse effect upon it.

Burying sleds incorporating water jetting and cutting nozzles extending from the bottom thereof and into the bottom of a body of water, while well known in the art, continue to pose several difficult problems in practical use. The burying sled may typically weigh, in air, 50 tons or more. It also has large physical dimensions and tends to be difficult to maneuver. Consequently, because of its great weight and physical size, great care must be exercised to prevent inadvertent damage to the sled, the pipeline or both. It is thus a very time-consuming expensive, and precise procedure to lower the sled into its operating position, straddling the pipeline.

Typically, the sled is lowered from a barge over a previously laid pipeline as nearly as possible to a position just above the pipeline. A diver helps control the lowering of the sled from the water bottom by signalling to the barge when to stop lowering the sled. Then, the diver, using his own physical effort, may maneuver the sled assembly to properly position the sled in precise alignment to and over the pipeline, with the jetting and cutting nozzles, the claw elements, in position to straddle the pipeline. Once the correct sled/pipeline orientation and alignment are achieved, the diver orders that the sled be lowered the final few feet to the sea floor. Thereafter the diver returns to the surface and entrenching begins.

If the sled must be raised from the water bottom, for example due either to periodic inspection and maintenance of the cutting assembly or to heavy weather at which time the barge must leave the area, significant time will be spent in repositioning the sled assembly over the pipeline. In addition, every time the sled is lowered toward and over the pipeline, the pipeline and its protective anticorrosive coating are vulnerable to damage from impact with the jetting nozzles or claws. Also, the nozzles or claws may be damaged, and if damaged the entrenching operation must be suspended until repairs are made.

Another problem associated with repositioning the sled over the pipeline is the decreasing capacity of the diver to handle and maneuver the sled as the water depth increases. This is because of impairment of the diver's physical capacity and the increasingly shorter durations for which he can remain under water at greater depths. In addition, poor visibility and rough environmental and meteoceanic conditions limit his capability at any depth. The result is either (a) to reduce the amount of time the diver stays down, (b) to prevent the diver from going down to or staying on the water bottom, or (c) to slow the diver's activities thereby increasing the time required for each step of the positioning process. These conditions, in addition to delaying the sled repositioning operation, also pose some additional hazards for the diver.

It is therefore a primary object of the invention to provide an improved method and apparatus for reliably entrenching pipelines using a burying sled having jetting or cutting nozzles. Other objects of the invention are an apparatus and method to safely position the claws or cutting nozzles relative to the pipeline even when visibility is poor, to reduce the chance of damage to either the sled or pipeline, to reduce "down time", to reduce the time required to position the burying sled, and to reduce the number and time duration of diver assisted operations.

Further objects of the invention include a method and apparatus which results in increased productivity, a simpler method of positioning the claws over the pipeline, and reduced vulnerability of damage to the pipeline during the positioning mode.

SUMMARY OF THE INVENTION

The invention relates to an apparatus and method for entrenching an elongated pipeline and the like on the bottom of a body of water. The apparatus features a burying sled base having first and second pontoon skids, the skids being generally parallel to one another and thus having generally parallel longitudinal axes. The skids are connected by a cross-support which allows the burying sled base to straddle the pipeline without danger of contact with it. The apparatus further features a trench cutting assembly for cutting a trench beneath the pipeline when the pipeline is on the water bottom. A remote connecting and disconnecting means operative in a first state for remotely connecting the cutting assembly in an operational relationship adjacent the sled base for entrenching the pipeline and in a second state for remotely disconnecting and separating the cutting assembly from the sled base is provided. In this way, the sled base may be left on the bottom of the body of water, aligned with the pipeline, and the cutting assembly may be raised aboard a floating vessel for inspection, repair, or temporary abandonment of the trenching operation.

In a particular aspect of the apparatus of the invention, there are featured an electrical umbilical between the vessel and the cutting assembly, a position determining means for providing information to the vessel indicating the position of the cutting means relative to the sled base, and a latch means controlled from the vessel for securing the cutting assembly to the sled base in the prescribed operational relationship and for releasing the cutting assembly from the sled base when the cutting assembly is to be removed from the operational relationship with the sled base, for example, for inspection, routine maintenance, or repairs. Typically, the cutting assembly may be provided with a controlled horizontal positioning means responsive to control signals from the vessel for adjusting the position of the cutting assembly in the horizontal plane. In preferred embodiments, the horizontal positioning means is a plurality of horizontally directed thrusters.

The apparatus also features a vertical positioning means carried by the vessel for changing the position of the cutting assembly in a vertical direction. The vertical positioning means includes a support means, typically a cable, extending from the floating vessel and connected to the cutting assembly, which, in the first state, effects a controlled lowering of the cutting assembly to the sled base at the bottom of the body of water, and in the second state, effects a controlled raising of the cutting assembly from the sled base at the bottom of the body of water.

Preferably, the position determining means includes both sonar and television transmitters and receivers to provide the information indicating the position of the cutting assembly relative to the sled base.

In a first aspect of a second embodiment of the invention, the remote connecting and disconnecting means comprises a buoyancy assembly having a buoyancy means, the buoyancy means having at least one state wherein the buoyancy assembly has a positive buoyancy for urging the buoyancy assembly upwards, and the assembly having at least one guideline (preferably two) and at least one driven rotating member (preferably two). Each guideline extends from a different driven rotating member between the buoyancy assembly and the sled base, one end of each guideline being secured to the sled base and the other end being secured to the respective driven rotating member of the buoyancy assembly. A cutting means is detachably secured to the buoyancy assembly, the cutting means and the buoyancy assembly together comprising the cutting assembly. The cutting means is secured to the buoyancy assembly by a second latch means which operates in response to a signal from the vessel. In this way, the cutting means and the buoyancy assembly can be remotely latched and then lowered, as a unit, to an operational relationship with the sled base by operating the driven rotating member. According to this aspect of the invention, the apparatus further includes the position determining means, electrical umbilical, and latch means described above in connection with the first embodiment of the invention.

In a second particular aspect of the second embodiment of the invention, the remote connecting and disconnecting means features at least one guideline (preferably two) and at least one driven rotating member (preferably two), each guideline extending from a different driven rotating member between the cutting assembly and the sled base. Thus, each guideline is secured at one end to the sled base and at the other end to the driven rotating member. The apparatus further includes a remotely controlled drive means for rotating each rotating member in response to an output signal from the vessel and a buoyancy means secured to and forming a part of the cutting assembly. The buoyancy means has at least one state wherein the net buoyancy of the cutting assembly urges the cutting assembly upward. The apparatus preferably further includes the position determining means, electrical umbilical, and latch means of the first aspect of the invention.

According to the method of the invention, there is featured a method for entrenching an elongated pipeline on the bottom of a body of water comprising the steps of placing a burying sled, having a burying sled base and a trench cutting assembly, at the bottom of the body of water in an operational relationship to the pipeline wherein the sled straddles the pipeline; pulling the sled base and trench cutting assembly along the pipeline to entrench the pipeline; remotely unlatching the trench cutting assembly from the sled base; remotely raising and removing the trench cutting assembly from its operational relationship with the sled base; leaving the sled base on the bottom of a body of water; remotely lowering the trench cutting assembly to its operational relationship with the sled base and the pipeline; and remotely securing the cutting assembly to the sled base in the operational relationship.

In other aspects of the invention, the method features the steps of guiding the trench cutting assembly into the operational relationship with the sled base. The method further features the steps of providing at least one guideline from the sled base to the trench cutting assembly to aid in the lowering and raising steps; and, when said trench cutting assembly includes a cutting means and a detachable buoyancy assembly, the steps of detaching the cutting means from the buoyancy assembly, removing the cutting means from the body of water, and leaving the buoyancy assembly beneath a wave action depth of said body of water.

When guidelines are used to aid in lowering and raising the cutting assembly as an integral unit, the method further features the steps of detaching the guidelines from the trench cutting assembly after the raising and removing step; attaching a float means to the detached guidelines; and placing the guidelines and floats into the water for later pickup and recovery.

DESCRIPTION OF THE DRAWINGS

Other objects, features, and advantages of the invention will appear from the following description of particular preferred embodiments of the invention taken together with the drawings in which:

FIG. 9 is a cross-sectional view of a power module showing the latch means;

FIG. 10A is a perspective view of the male cooperating latch member according to the invention;

FIG. 10B is a cross-sectional view along A—A of FIG. 9 with the latch pocket in the unlatched position; and FIG. 10C is a cross-sectional view along A—A of FIG. 9 with the pocket in the latched position.

DESCRIPTION OF PARTICULAR PREFERRED EMBODIMENTS

According to the invention, the apparatus and method for entrenching an elongated pipeline and the like employs a floating vessel 10 and a burying sled 12. The burying sled comprises a sled base 14 and a trench cutting assembly 16. Cutting assembly 16 may be detachably connected to or disconnected from an operational relationship with the sled base in response to remotely generated control signals from the vessel. The vessel 10 controls the entrenching process, according to the preferred embodiment of the invention and can, according to at least one embodiment, provides means to raise and lower, and connect and disconnect, the trench cutting assembly and the sled base without the need of diver assistance.

Figure 1A:
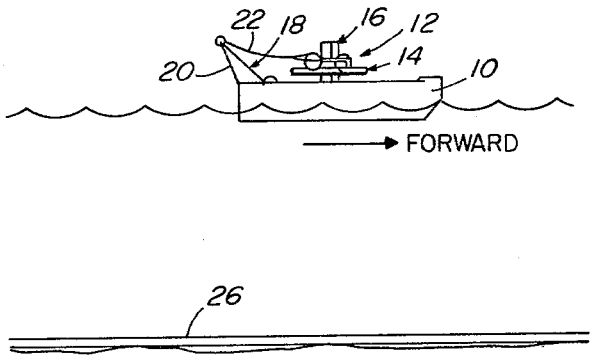
FIGS. 1A–1S represent a schematic outline of the steps of the method of the invention using apparatus constructed according to the invention.

Referring now to FIGS. 1A–1S, according to the method and apparatus of the invention, the floating vessel 10, typically a barge, carries the burying sled 12 which includes the sled base 14 and the trench cutting assembly 16. The floating vessel 10 further includes a winch assembly 18 having an A-frame assembly 20 and a lifting support line or cable 22, for example a flexible cable, connected to the cutting assembly 16.

Figure 1B:
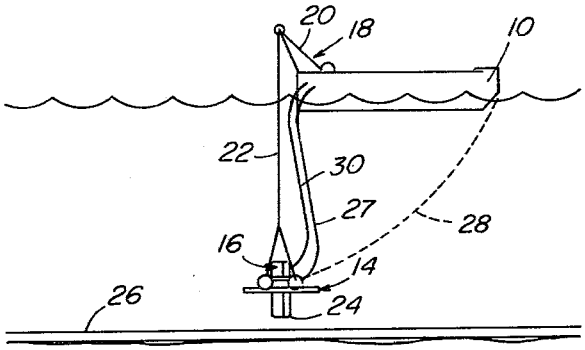
Figure 1C:
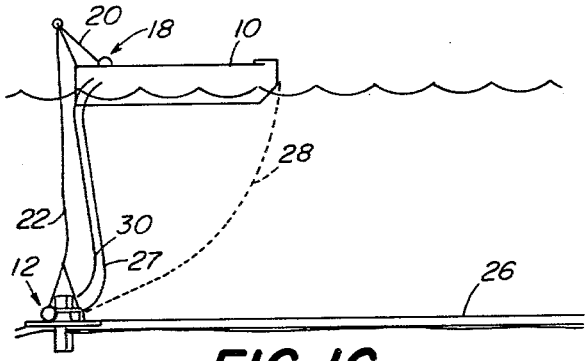

Referring to FIG. 1A, in a first embodiment of the invention, the instrumented embodiment, the burying sled including the sled base and trench cutting assembly are transported on board the vessel to a location over the pipeline to be entrenched or buried. After the pipeline has been located and the barge has been positioned approximately over the pipeline, the burying sled is lifted off the barge by winch assembly 18, A-frame assembly 20 and support line 22, and is lowered into the water. As shown in FIG. 1B, the burying sled is lowered so that the lower extremity 24 of the trench cutting assembly is just above and unable to contact the elongated pipeline member 26. While many methods may be used to determine the position of the sled relative to the pipeline, most conveniently a diver is sent down at this initial stage of the operation to provide the feedback needed to lower the sled to the proper position. With the burying sled thus positioned above the pipeline, a diver will descend (or if a diver aided in the previous lowering step, the same diver) and help accurately and precisely align and position the sled above the pipeline, so that it will straddle the pipeline when fully lowered. With the sled so positioned, the diver orders that it be lowered whereby the sled base rests on the water bottom while straddling the pipeline (FIG. 1C). Usually the claws of the cutting assembly reach the bottom first and stab into the seabed. The diver returns to the surface and then the jetting pumps are started and the claws penetrate the seabed until sled pontoons come to rest on the sea-floor.

Prior to lowering the sled on the water bottom, an electrical umbilical 27, a tow line 28, and fluid flow lines 30 are connected to the cutting assembly. The electrical umbilical provides electrical power and signal communication between the vessel and the cutting assembly and the fluid flow lines provide air and water under high pressure to effect cutting and subsequent spoil removal.

With the burying sled thus in position, the necessary fluid flows are initiated. The burying sled is pulled forward by vessel 10 by means of tow line 28, cutting a trench into which the pipeline will fall.

The detailed operation of the burying sled in forming a trench, including the supply of fluids, the removal of the spoil, the detailed structure of the jetting nozzles, etc., do not form a part of the present invention. These details are, however, described in Perot, Jr., U.S. Pat. No. 3,751,927, issued Aug. 14, 1973, and in Good et al, U.S. Pat. No. 3,786,642, issued Jan. 22, 1974, which descriptions are incorporated herein by reference.

Figure 1D:
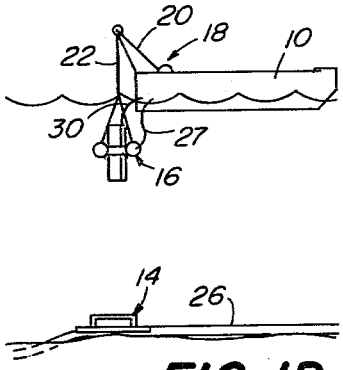
Figure 1E:
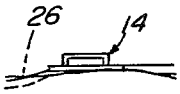

In the normal operation, the trench cutting assembly 16 will be periodically inspected for routine maintenance, and at other times, entrenching operations will be discontinued due to poor weather conditions resulting, for example, in rough seas. In either case, the entrenching operation must cease. According to prior teaching and technology, the entire sled was then raised away from the pipeline and lifted onto the vessel 10. According to the invention, however, when the entrenching operation is interrupted prior to completion, only the trench cutting assembly is raised, leaving the sled base in an aligned position relative to the pipeline on the water bottom. Thus, the cutting assembly is unlatched from its operational relationship to the sled base 14 and is raised by itself (FIG. 1D), away from the sled base. The trench cutting assembly may then be removed from the water and lifted on board the vessel 10. For routine inspection and maintenance, the cutting assembly can then be inspected and repaired as necessary on board the vessel and a diver may be sent down to inspect the sled base. If necessary, a new trench cutting assembly may be "plugged in" if the old one is found to be damaged or in need of lengthy repairs or maintenance. In case of foul weather or dangerous seas, the vessel 10 can leave the area for the shelter of a good harbor, leaving the sled base 14 safely on the bottom of the body of water straddling the pipeline (FIG. 1E).

Figure 1F:
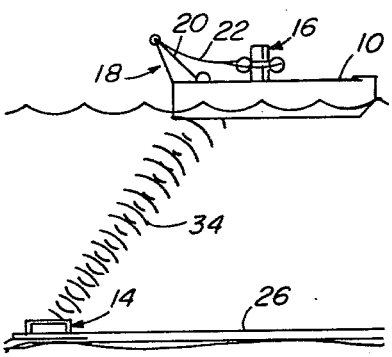
Figure 1G:
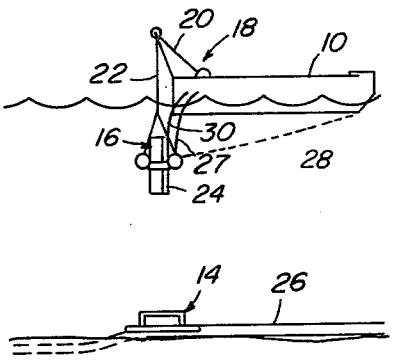
Figure 1H:
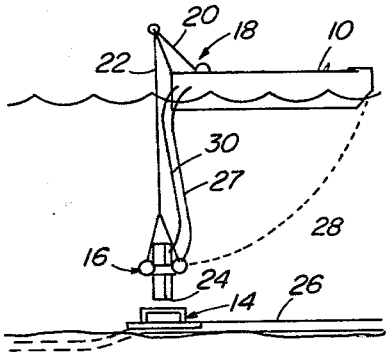
Figure 1I:
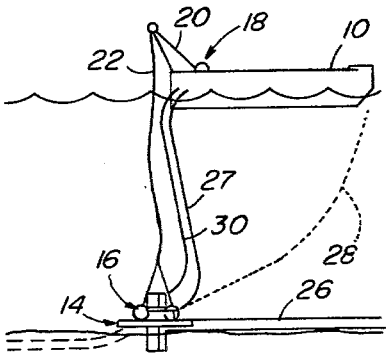

When the weather clears and pipeline entrenching can begin again, the barge or floating vessel 10 returns to the area where entrenching was stopped, and, using sonar or another position determining device, indicated by the curved lines 34 in FIG. 1F, for the first embodiment, locates the sled base on the bottom of the body of water. The vessel 10 is then positioned substantially over the sled, and the cutting assembly is lifted off the vessel and put into the water (FIG. 1G). Then, using sonar or another position determining means either located on the cutting assembly and/or the vessel 10, depending upon the particular embodiment and needs of the system, the cutting assembly is maneuvered down toward and slightly above the sled base 14 (FIG. 1H). (The procedure described in connection with FIGS. 1G, 1H, and 1I is also used when the cutting assembly is withdrawn from the water for routine maintenance or repair wherein the vessel does not leave the area.)

When the cutting assembly is sufficiently close to the sled base, in this preferred embodiment, a television camera transmitting and receiving system is operated to provide direct visual feedback for remotely connecting the cutting assembly to the sled base. The television camera (not shown) is preferably secured to the cutting assembly and the receiver (also not shown) is located on the barge or vessel 10. Electrical video signals between the barge and the cutting assembly are carried through electrical umbilical 27.

Using information provided by the position determining means (either sonar or television in this embodiment), the cutting assembly is maneuvered in the horizontal plane, using for example horizontally directed thrusters (not shown) and the cutting assembly is thereby precisely positioned over and aligned with the sled base. As the cutting assembly is thereupon lowered toward the sled base and preferably prior to the time when the lower extremity 24 of the cutting assembly could reach or contact the pipeline, mechanical cooperating guide means on the sled base and the cutting assembly engage and further guide, orient, and align the cutting assembly relative to the sled base. (The sled base is already properly oriented and aligned with respect to the pipeline). The cutting assembly is thus properly positioned in its operational relationship to the sled base and the pipeline, and once that operational relationship is attained, a latch means is activated in response to a control signal from the vessel to secure the cutting assembly in its operational relationship with the sled base (FIG. 1I). Thereafter cutting and entrenching begins and proceeds in the manner previously described as the sled is towed along the pipeline.

Figure 1J:
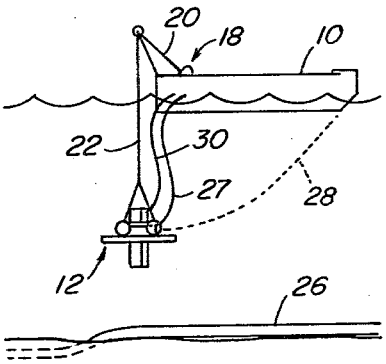
Figure 1K:
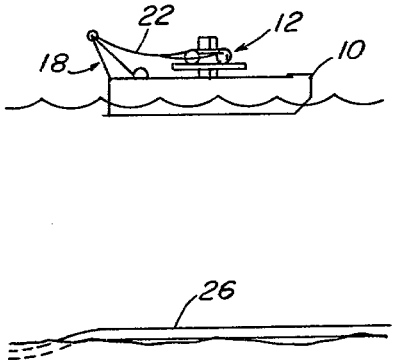
Figure 2A:
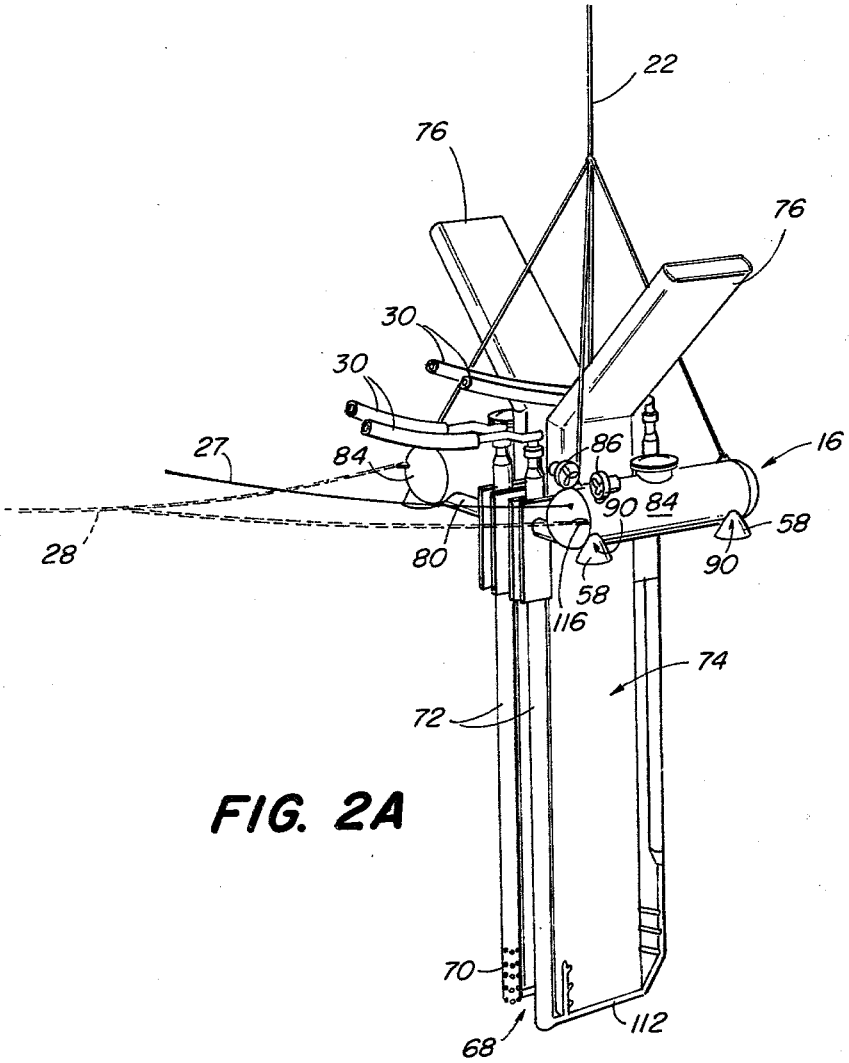
FIG. 2A is a prespective view of the trench cutting assembly according to a first embodiment of the invention.
Figure 2B:
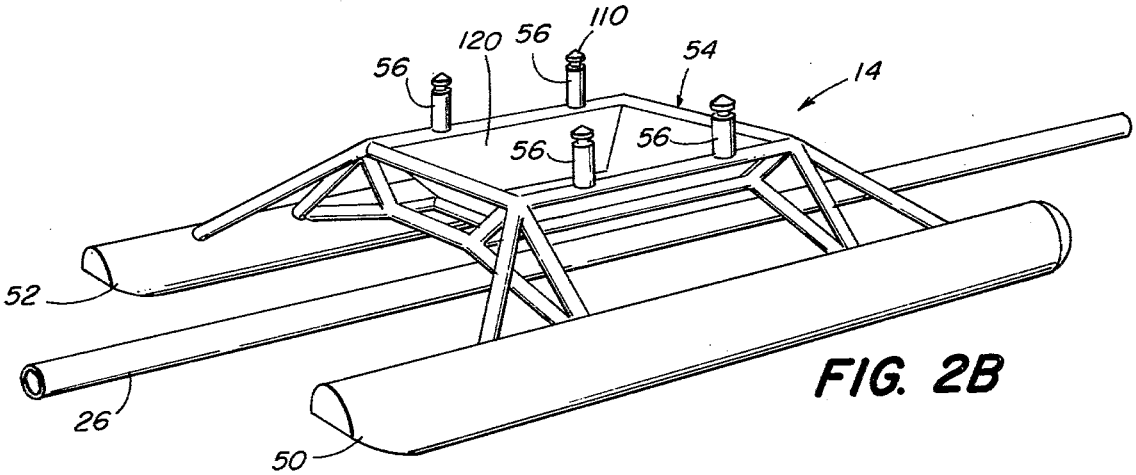
FIG. 2B is a perspective view of the sled base according to the first embodiment of the invention.

After pipeline entrenching is completed, the entire burying sled assembly 12 is raised, with the cutting assembly attached to the sled base, (FIG. 1J) and lifted on board the vessel (FIG. 1K). Thereafter the vessel proceeds to another operating location or to a port.

In another embodiment of the invention, a guideline or guidewire system is provided for guiding the trench cutting assembly into its operational relationship with the sled base. Referring to FIG. 1L, in this embodiment, the trench cutting assembly 16 includes winch assemblies 40 and guidelines 42A and 42B connected between the winch assemblies and the sled base. Having the sled base positioned and aligned with respect to pipeline 26 (FIG. 1C), the cutting assembly can be raised to the surface, when necessary, as follows. The cutting assembly is unlatched from the sled base, and the winch assemblies 40, in response to an electrical control signal from the vessel, unwind guidelines 42A and 42B. In response, the cutting assembly, which may be positively buoyant, is urged vertically upward, disengaging from its operational relationship with the sled base. If needed, the lifting support line 22 may be used to aid in raising the cutting assembly 16.

In the first aspect of the guideline embodiment of the invention (FIGS. 1M–1R), the cutting assembly includes a cutting means, claw portion 44, detachably connected to a buoyancy assembly 46. In this first aspect of the guideline embodiment, when the cutting assembly 16 is raised to within about 50–60 feet of the surface of the body of water, the claw portion, which includes the jetting and spoil removal systems, is released or unlatched from the buoyancy assembly, which includes buoyancy means 48 and winch assemblies 40. This preferably occurs in response to a control signal generated on board the vessel (FIG. 1M). The buoyancy assembly 46 is clamped or locked in place, and the claw portion is then lifted on board the vessel (FIG. 1N). On board vessel 10, repairs or maintenance to the claw portion 44 may be performed.

If the vessel had left the area of the entrenching operation, on its return, sonar is used to locate the buoyancy assembly FIG. 1N (or the sled base FIG. 1F) lying beneath the surface of the water. Once found, the winches on the buoyancy assembly which maintain the buoyancy assembly at the desired depth, are released, and the positively biased buoyancy assembly rises to the surface of the body of water (FIG. 1P). The claw portion is then lowered into its operational relationship with the buoyancy assembly (FIG. 1Q) and is secured in place by a second latching means to be described hereinafter. The winch members 40 are now operated under control of means carried on board the vessel and winch down the preferably positively buoyant cutting assembly 16 into its operational relationship with sled base 14 for further entrenching operations (FIG. 1R) as described above in connection with the previous embodiment of the invention.

In the second aspect of this guideline embodiment of the invention, the cutting assembly is an integral unit and must be raised as a unit onto the floating vessel 10. In this aspect, if the vessel is going to leave the location, guideslines 42A and 42B are disconnected from the cutting assembly, attached to auxiliary floats 49, and thrown overboard (FIG. 1S). The floats remain on the top surface of the body of water so that when the barge or vessel 10 returns, the guidelines are easily retrieved and reattached to the respective winch assemblies 40 of cutting assembly 16. The cutting assembly would then be lifted off the vessel, lowered into the water, and guided to its operational relationship with the sled base.

The cutting assembly is lowered to that operational relationship by winding the guidelines around driven rotating drums of winch assemblies 40 thereby pulling the preferably upwardly biased cutting assembly 16 toward the sled base. As the cutting assembly reaches the vicinity of the sled, and preferably before the lower extremity 24 of the cutting assembly reaches or can contact the pipeline, cooperating mechanical guide members on the cutting assembly and sled base cooperatively guide the cutting assembly into the proper alignment with the sled base. After the correct operational relationship is reached, the cutting assembly is latched to secure it to the sled base.

Figure 3:
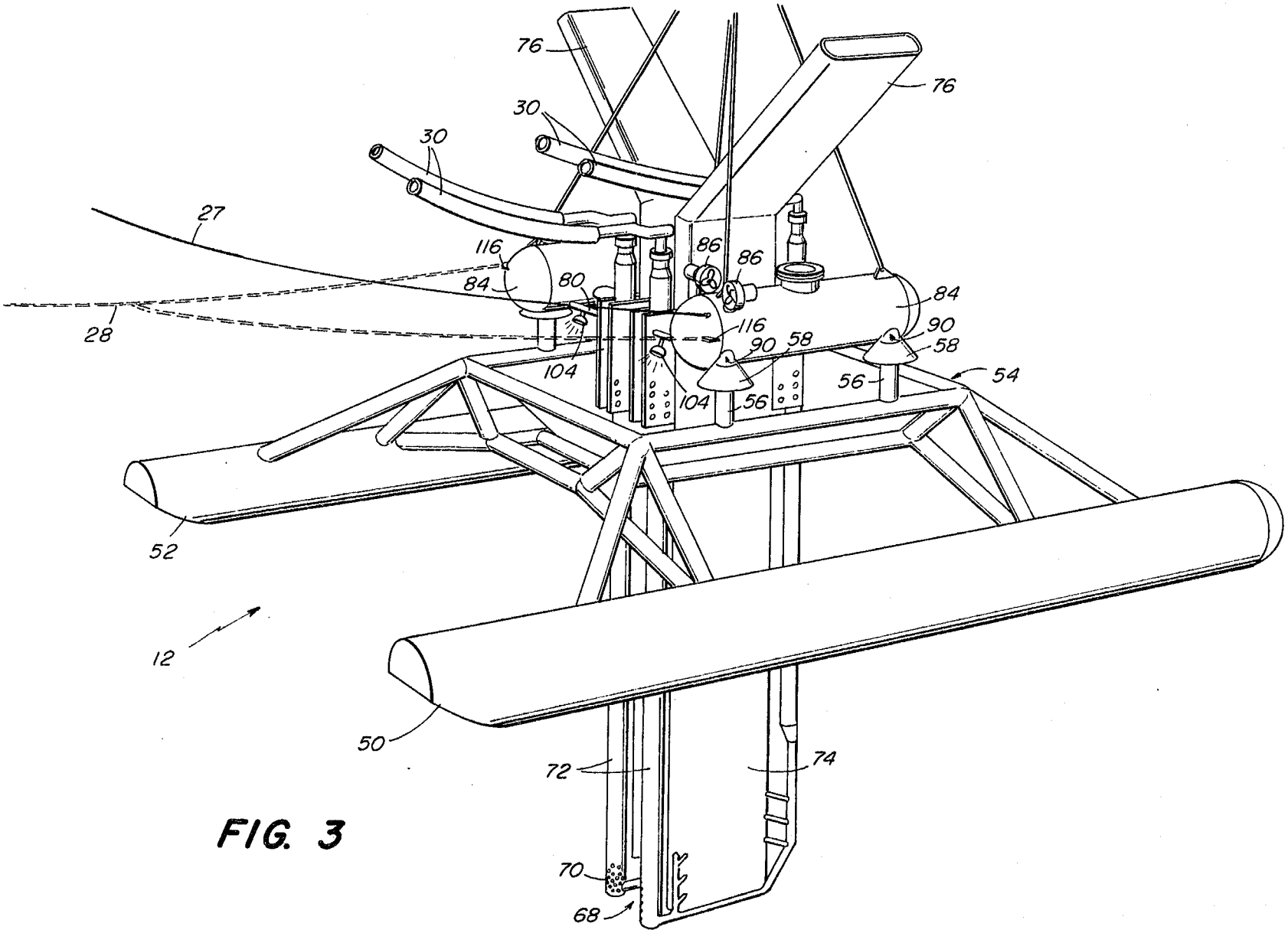
FIG. 3 is a perspective view of the trench cutting assembly in its operational relationship with the sled base according to the first embodiment of the invention.
Figure 4:
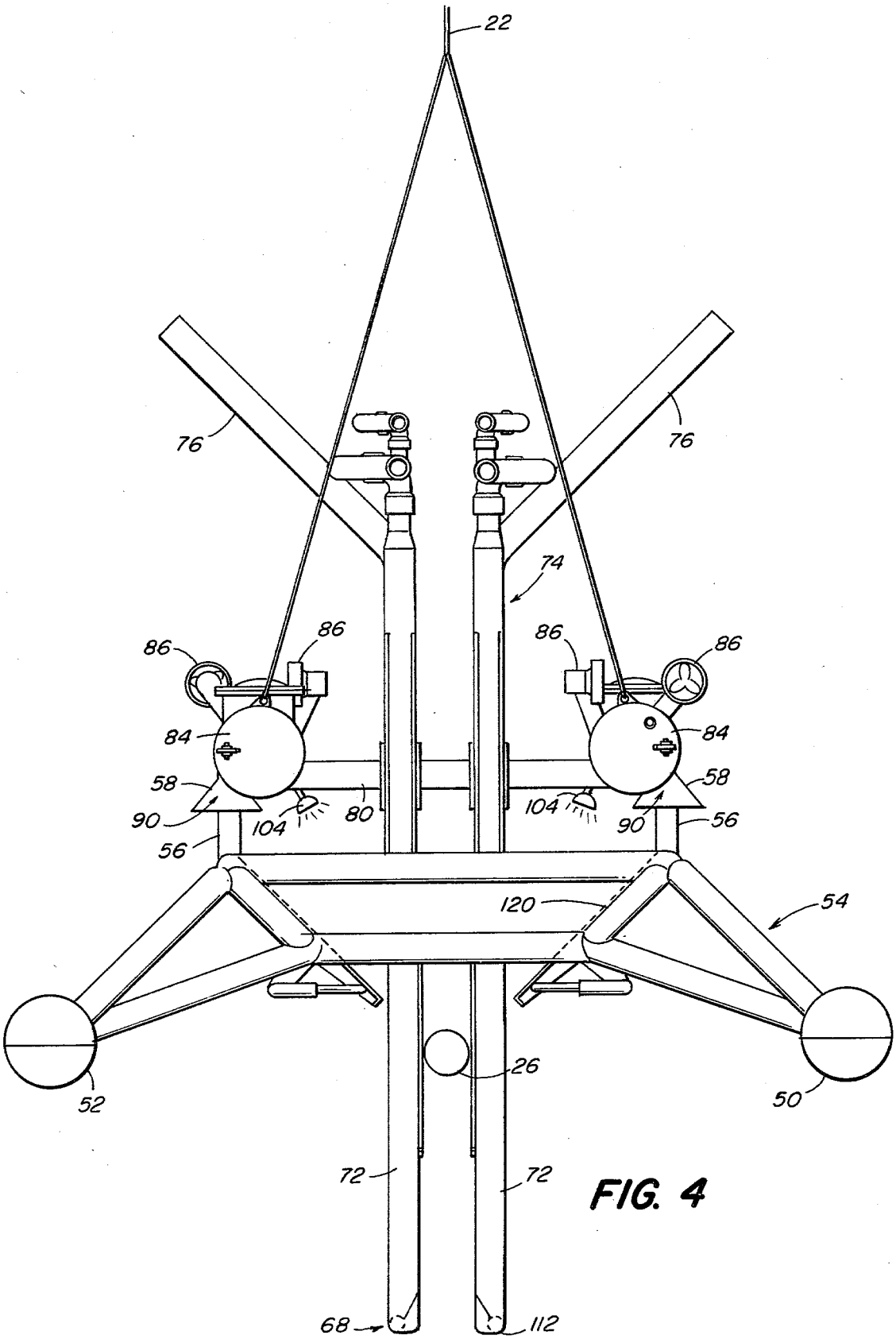
FIG. 4 is an elevation view of the trench cutting assembly in its operational relationship with the sled base according to the first embodiment of the invention.

Referring now to FIGS. 2A, 2B, 3 and 4, the burying sled according to the first (instrumented) embodiment of the invention includes the sled base 14 (FIG. 2B) and the trench cutting assembly 16 (FIG. 2A) which, during the entrenching process, are latched or connected together in an operational relationship (FIGS. 3 and 4).

The sled base has first and second pontoon skids 50, 52 which have generally parallel longitudinal axes and which are connected together by a cross-support assembly 54. This construction is well known to those skilled in the art and shall not be described in further detail. The cross-support assembly connects the pontoon members 50, 52 so that the sled base 14 may safely straddle the pipeline 26 to be entrenched. The sled base does not contact the pipeline. Typically, the sled base may weigh, in air, about 50 tons.

In this embodiment, designated the totally instrumented embodiment, the sled base is provided with a plurality of fixed cooperating latch members 56 which are adapted to cooperate with conical guide members 58 on the cutting assembly to guide the cutting assembly into its operational relationship with the sled base. The structural elements of the sled base are interconnected in a rigid integral assembly, for example, by welding.

The trench cutting assembly 16 (FIG. 2A), which is designed to be lowered into an operational relationship with the sled base, includes a liquid cutting and jetting system 68 comprising jetting nozzles 70 in a tubular structure 72, and a spoil removal system 74 including an air lift eductor 76. The jetting system and the spoil removal system are each supplied with fluids under high pressure from vessel 10 through supply hoses 30. This system is well known in the art and is described in detail in the Perot and Good et al patents cited hereinabove.

The jetting and spoil removal systems are structurally supported on a structural frame 80. Frame 80 also supports that portion of a remote connecting and disconnecting means which forms part of the cutting assembly. The remote connecting and disconnecting means is designed to facilitate lowering and raising of the cutting assembly into and out of its operational relationship to the sled base without the need of diver interaction. Included in the cutting assembly, in this particular embodiment, are power modules 84, one on either side of the eductor system 76, thrusters 86, a lifting support cable 22, and a plurality of remotely controlled cooperating latch members 90 (FIG. 4). The power module 84 is connected to the vessel by electrical umbilical 27 and receives both power and control signals through umbilical 27.

The power modules 84 are maintained at a pressure of one atmosphere and while providing some buoyancy for the cutting assembly, are still small enough so that the entire assembly is negatively biased. The power modules include means responsive to a means carried on board the vessel for helping to determine the position of the sled base relative to the cutting assembly by providing information indicating that relative position to the vessel. The power modules also include means responsive to means on board the vessel for operatively activating the thrusters 86. In some embodiments it may be desirable to add buoyancy tanks whose effective buoyancy can be varied in response to a control signal from the vessel.

The position determining means on the cutting assembly in this preferred embodiment includes both a sonar ranging and location device (not shown) for roughly determining the location of the sled base relative to the cutting assembly and a television camera (not shown) carried by the cutting assembly and activated by means on board the vessel when the information provided by the sonar device indicates that the cutting assembly is within visual contact of the sled base. The television system [the receiver (not shown) is on board the vessel] provides a visual observation of the location of the sled base. If desired, a lighting system 104 may also be included with the television camera on the cutting assembly to provide a better visual determination of the sled base location. The lighting system is especially useful in dark waters. The electrical equipment carried by the cutting assembly 16 is secured within or supported by power modules 84 by means well known in the art.

In operation, as outlined in connection with FIGS. 1A–1K, when the cutting assembly is being lowered into position by a vertical positioning means controlled from the vessel, thrusters 86 are actuated as needed, to locate the cutting assembly over the sled. As the cutting assembly approaches the sled, the lower extremity 112 of the claw contacts the sloping guiding surfaces 120 on the sled base which in turn orient and align the cutting assembly into the operational relationship with the sled base. As the cutting assembly is lowered, the ends 110 of fixed cooperating member 56 on the sled base then begin to engage cone shaped guide members 58 on the cutting assembly for latching into the operational relationship with the sled base. Preferably, cross-support members 54 and the cooperating member 56 on the sled base are raised sufficiently above the pontoon skids 50, 52 so that the guiding effect of guide cones 58 effectively aligns the cutting assembly with the sled base before the lowest portion 24 of the cutting assembly can reach or contact the top of the pipeline to be entrenched. This added safety feature ensures that no damage to the pipeline or jetting and spoil removal system will occur as the cutting assembly is lowered in its operational relationship with the sled base.

After the cutting assembly is in its operational relationship with the sled base (FIGS. 3 and 4), and as preferably indicated by a switch means (not shown) on the cutting assembly, each cooperating latch member 90, in response to a control signal from the vessel, is rotated through an angle of substantially 90° to interlock the cooperating member pairs to secure the cutting assembly to the sled base. The two cable 28, preferably connected to the cutting assembly at towing pad eyes 116 is tensioned and the complete burying sled 12 is pulled along the pipeline to entrench it.

Figure 6:
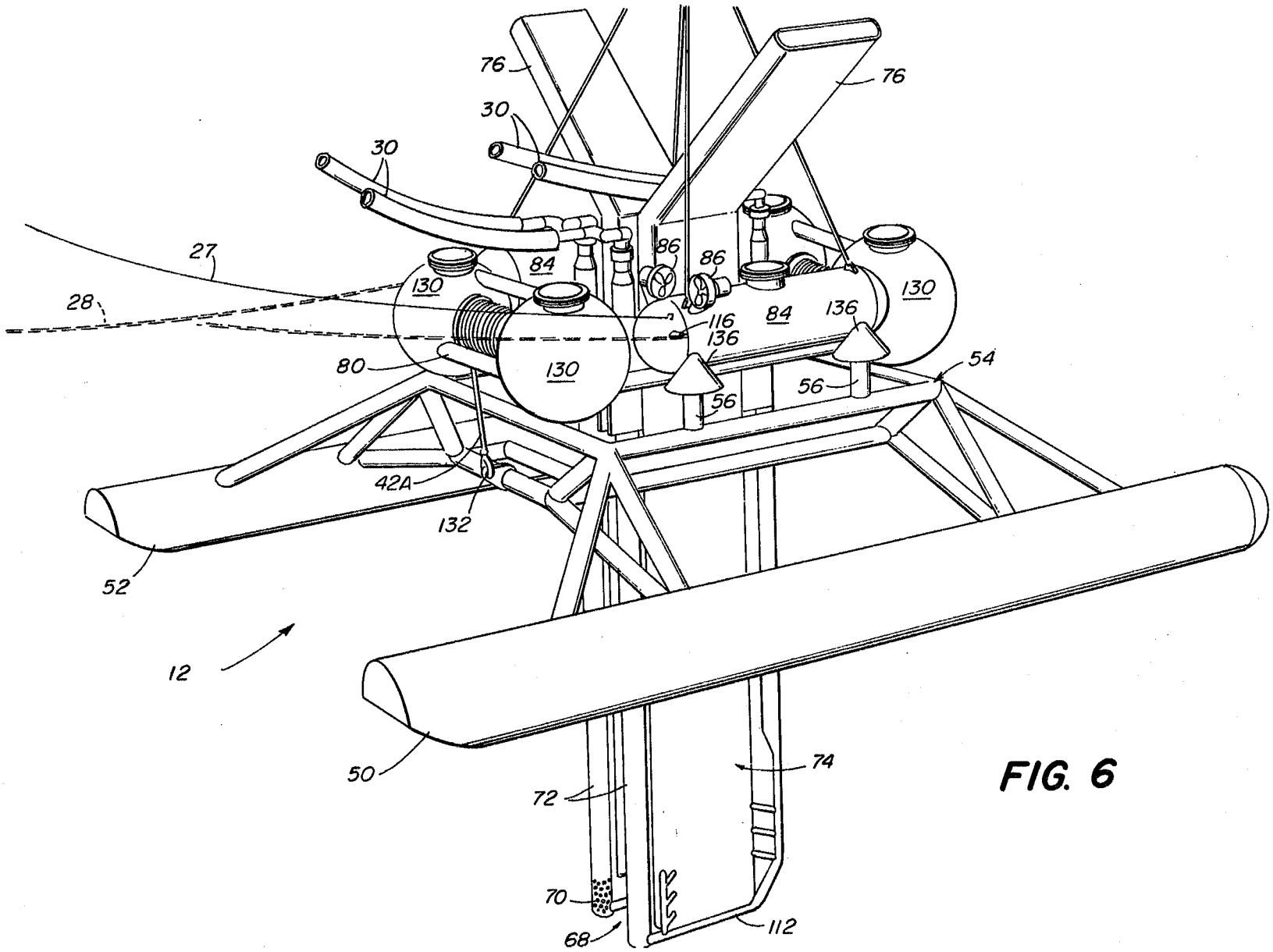
FIG. 6 is a perspective view of the trench cutting assembly in its operational relationship with the sled base according to the first aspect of the second embodiment of the invention.
Figure 7A:
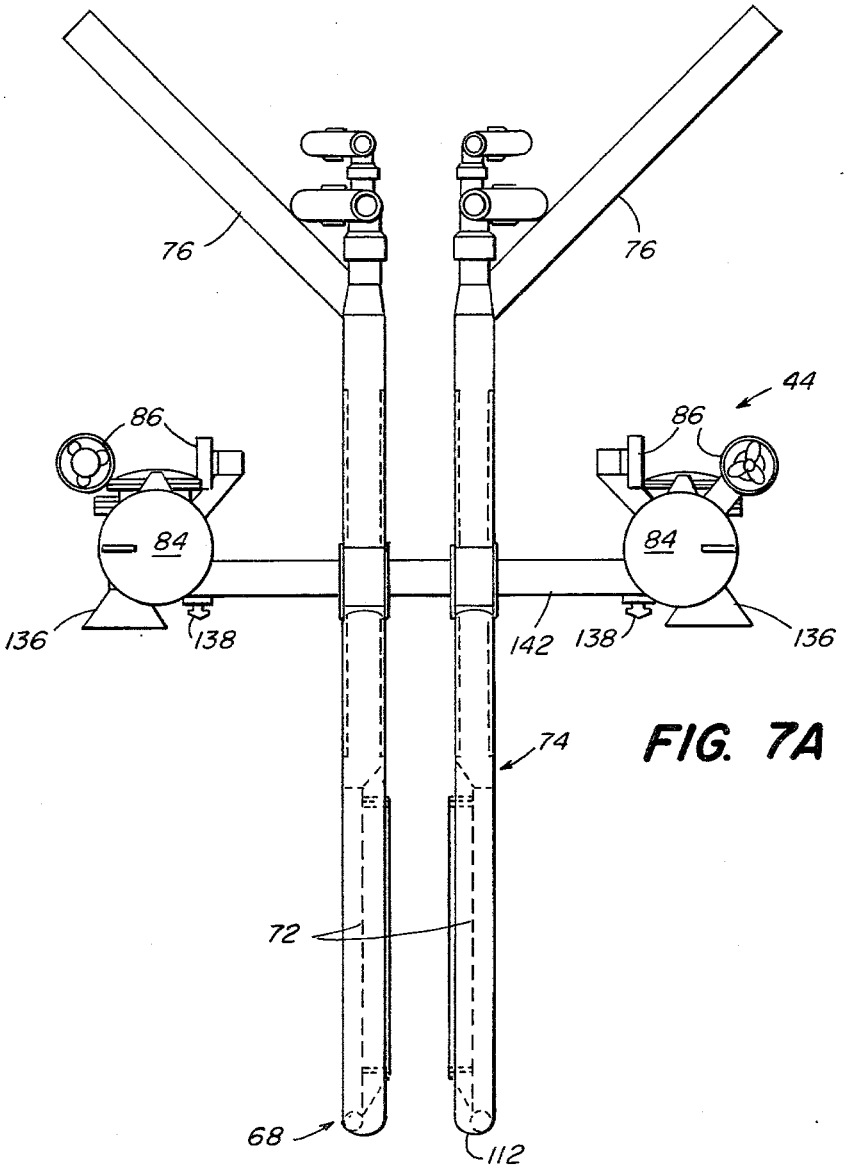
FIG. 7A is an elevation view of the cutting means according to the first aspect of the second embodiment of the invention.
Figure 7B:
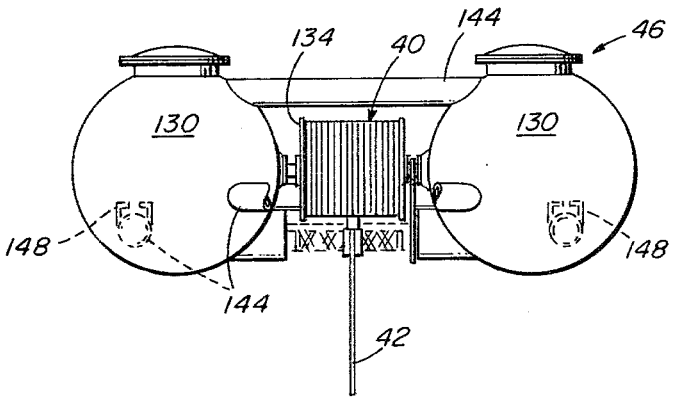
FIG. 7B is an elevation view of the buoyancy assembly according to the first aspect of the second embodiment of the invention.

In a second particular embodiment of the invention, the sonar and television position determining means on the cutting assembly are either replaced or supplemented by at least one and preferably two guideline cables 42A and 42B connected between the sled base and the cutting assembly. In a first aspect of this guideline embodiment (FIGS. 5, 6, 7A and 7B), the cutting assembly includes the detachable cutting means, claw portion 44, (FIG. 7A) and buoyancy assembly 46 (FIG. 7B). The claw portion in this aspect of the guideline embodiment comprises the jetting system 68, the spoil removal system 74, and the power or machinery modules 84. The buoyancy assembly in this particular aspect of the guideline embodiment comprises at least one and preferably two winch assemblies 40, and a buoyancy means 130.

In the other or second aspect of the guideline embodiment (FIG. 8), the cutting assembly is a single integral unit comprising the jetting system 68, spoil removal system 74, winch assemblies 40, and power modules 84. Power modules 84, in this particular aspect, have an enlarged volume to provide the required upward buoyancy for the cutting assembly. Where possible, like reference numbers are used to describe like parts of the various embodiments of the invention.

Figure 5:
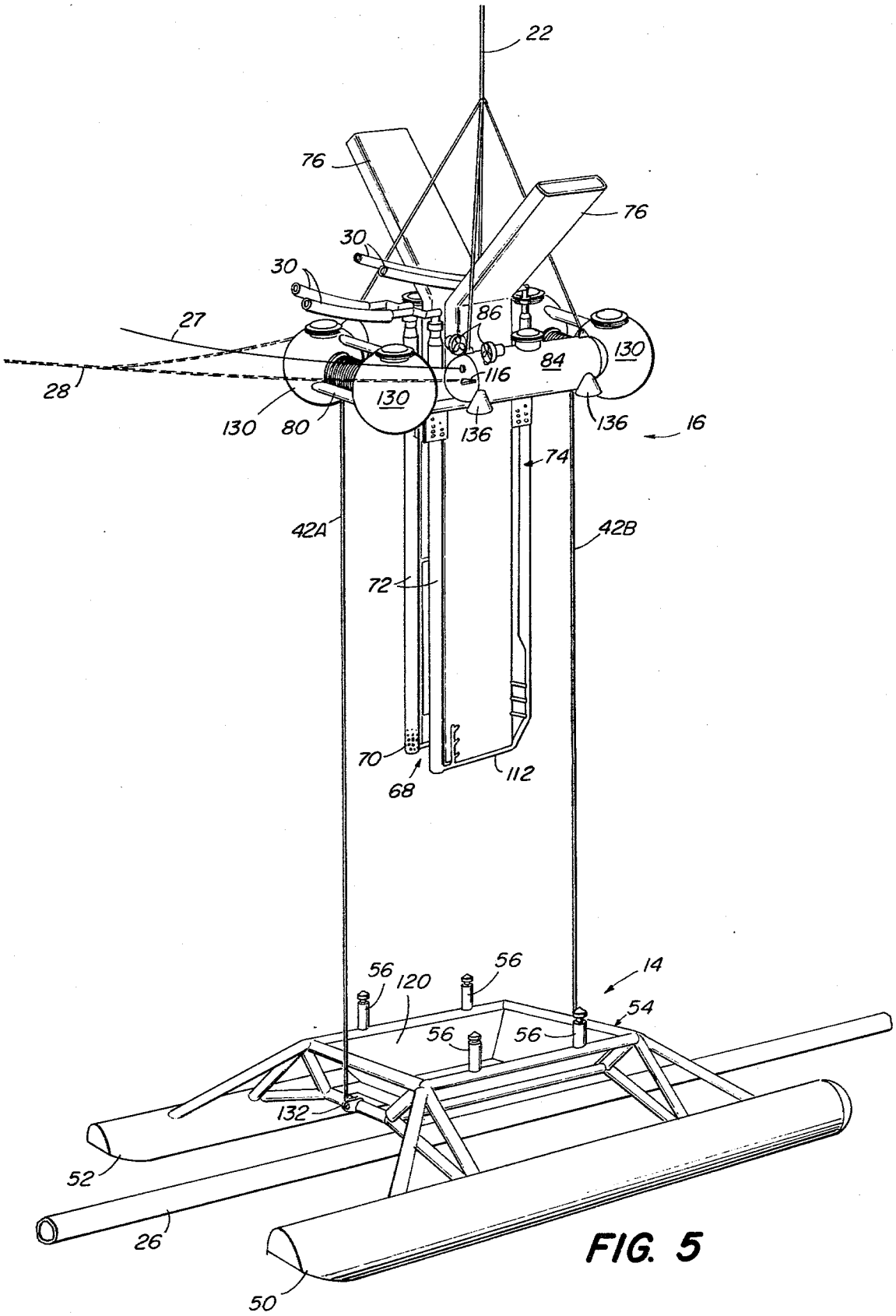
FIG. 5 is a perspective view of the trench cutting assembly and sled base according to a first aspect of a second embodiment of the invention.

Referring to FIG. 5, in the first aspect, the trench cutting assembly is connected to and above the sled base 14 by two guidelines 42A and 42B. The guidelines are each connected to the sled base at a cross-support structural member using a pad eye connection 132. At their other end, guidelines 42A, 42B are each connected to winch assemblies 40, and in particular to a driven rotating member 134 of each winch assembly, shown as a drum, which is driven by means (not shown) responsive to signals through the electrical umbilical 27 from the vessel. As members 134 are driven in response to control signals from the vessel to wind (or unwind) guidelines 42A, 42B, the cutting assembly is lowered (or raised) and approaches (or becomes farther from) the sled base. As described in connection with the first embodiment of the invention, before the bottommost portion 112 of the claw portion reaches the pipeline, the cutting assembly is guided, orientated, aligned, and engaged into the proper operational relationship with the sled base and hence with the pipeline. The driven rotating members 134 then continue to draw the trench cutting assembly into its operational relationship with the sled base and when in that operational relationship, latch assemblies, described in greater detail later, secure the cutting assembly to the sled base (FIG. 6). As an added safety measure, the winch assemblies 40 and in particular the driven rotating drum 134 can be locked to provide an additional margin of safety, if, for some unforeseen reason, the latches are incapable, alone, of holding the sled base and cutting assembly together.

As noted above, the cutting assembly 16, in this aspect of the guideline embodiment, comprises the claw portion 44 and the buoyancy assembly 46. The claw portion (FIG. 7A) in this aspect includes the jetting and spoil removal systems 68, 74, and the power modules 84. Each power module 84 has extending downwardly therefrom at least one rotatable latching means member 136. The latch means member 136, described generally in connection with the first embodiment, is operative, to connect the claw portion (and buoyancy assembly) to the sled base. There is another latch means member 138 on a frame structure 142 which is effective to connect the claw portion securely to the buoyancy assembly as described in more detail below. The power modules and the jetting and spoil removal systems are interconnected by and supported on the frame structure 142 which is substantially rectangular in shape.

The buoyancy assembly, preferably comprising spherical buoyancy tanks 130 and winch assemblies 40, is structurally supported in a substantially rectangular configured frame structure 144 (FIG. 7B). Frame structures 142 and 144 are so sized and the various supported equipment so placed, that the claw portion 44 may be lowered onto and substantially rest on a portion of frame structure 144 of buoyancy assembly 46. As the claw portion is lowered toward its operational relationship with the buoyancy assembly, each latch member 138 engages and is guided by a corresponding cooperating fixed latch member 148 structurally connected to frame 144. Each latch member 148 has a semi-circular cup-shaped guide member (not shown) to guide and align the cutting means in its operational relationship with the buoyancy assembly. Once that operational relationship is achieved, latch member 138 is rotated, in response to a signal from the vessel to the power module, through an angle of substantially 90° as described hereinafter to secure the claw portion in its operational relationship with the buoyancy assembly. There is thus formed the trench cutting assembly 16 which is ready to be lowered, as one unit, into its operational relationship with the sled base 14 as described above.

Cooperating latch member pairs 138, 148 while operating in a similar manner to latch member pairs 136 and 56, have the male and female portions of the connector reversed. The two structures are however equivalent and are described in greater detail below.

Since the electrical umbilical 27 is connected to the power modules 84 of the claw portion, an electrical connector (not shown) is provided between the claw portion and the buoyancy assembly to provide electrical power and signal connections therebetween and in particular to provide drive power for rotating drums 134. The electrical connector may be any of the type approved for underwater use, however, a particularly preferred type is a "quick disconnect" connector which automatically disconnects when the claw portion is separated from the buoyancy assembly but which requires a manual reconnection (for example by a diver) when the claw portion is thereafter reconnected to the buoyancy assembly. Other types of connector, which may connect and disconnect totally automatically, totally manually, or in other combinations may also be used.

As noted above, after the claw portion is separated from the buoyancy assembly (and when the cutting assembly is secured to the sled base), winch assemblies 40 are typically clamped or locked to avoid further movement of the buoyancy assembly. This may be implemented using solenoid controls (not shown) which in one state mechanically interfere with and prevent rotation of the driven rotating drums 134 and in a second state leave the drums free to rotate. In order to release the winch assemblies after the claw portion is separated from the buoyancy assembly, at a time when there is no electrical connection between the vessel 10 and the buoyancy assembly, (e.g., when the buoyancy assembly is 50–60 feet below the surface of the water), according to a preferred embodiment of the invention, an acoustically activated solenoid valve powered from an accumulator is used, a device which does not require electrical power to operate. Other methods to release the winch assemblies include sending a diver down to manually release the clamping mechanism or to provide the buoyancy assembly with its own electrical energy source, for example, battery power, to effect release of the winch assemblies in response to a coded acoustical signal from the vessel 10.

Figure 8:
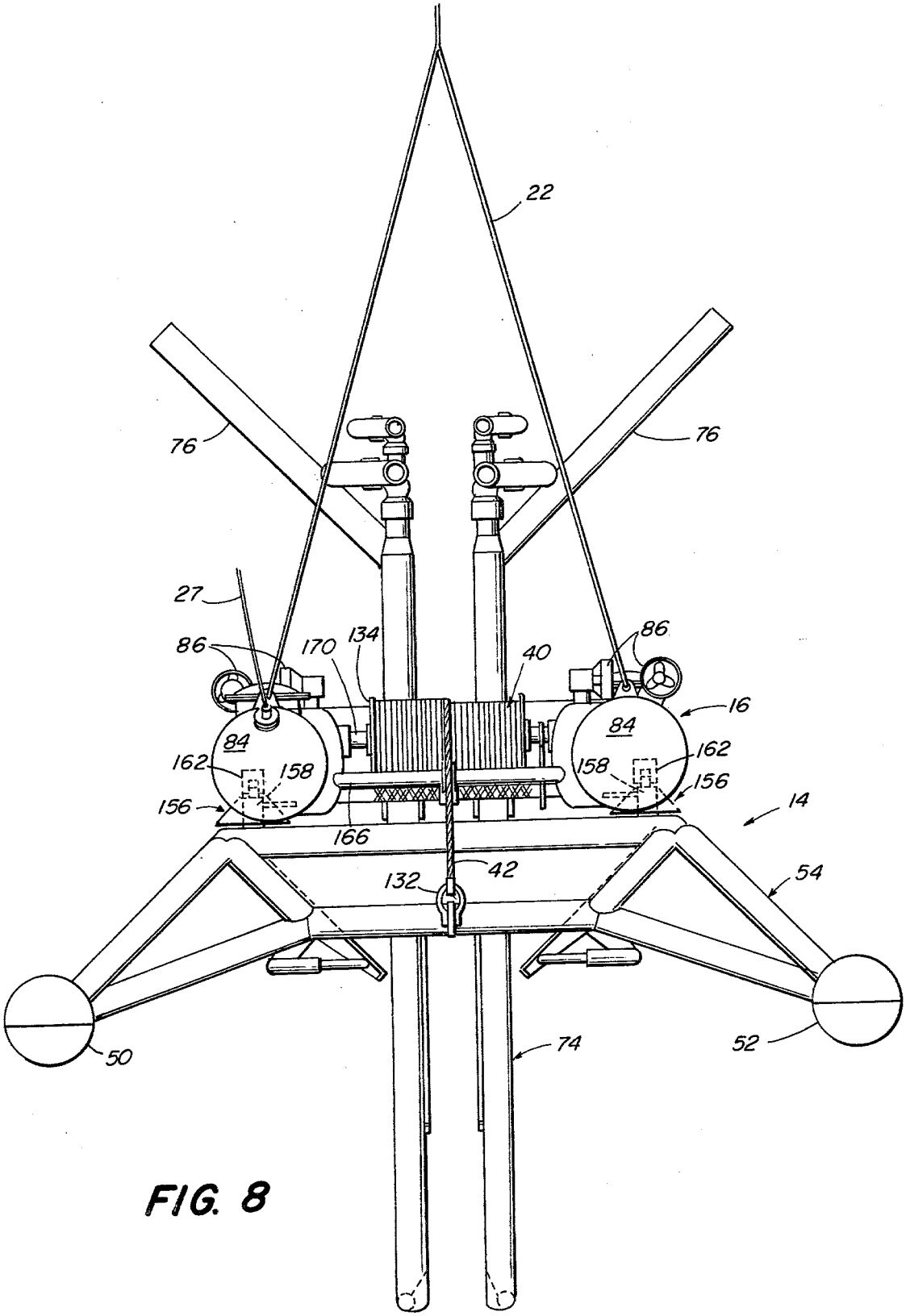
FIG. 8 is an end elevation view of the cutting assembly secured in its operational relationship to the sled base, according to a second aspect of the second embodiment of the invention.

Referring to FIG. 8, in the second aspect of the guideline embodiment of the invention, the spherical buoyancy tanks 130 are preferably not used and the winch assemblies 40 are structurally secured between power modules 84 to a frame 166 of the claw portion to form, in combination with the power modules 84 and the jetting and spoil removal systems, the cutting assembly. Thus, there is no buoyancy assembly 46. The trench cutting assembly of this second aspect is substantially identical structurally (with the addition of winch assemblies 40) to the cutting assembly of the first embodiment. The trench cutting assembly 16 is shown secured in its operational relationship to the sled base 14 in FIG. 8. The sled base 14 of FIG. 8 is substantially identical to the sled base 14 described in connection with the first aspect of the guideline assembly.

The power or machinery modules 84, associated with the guideline embodiment of FIG. 8, are as noted above, larger in physical size than the corresponding power modules of the previous guideline embodiment, FIGS. 5 and 6. The larger size provides a greater buoyancy which is needed to compensate for the loss of buoyancy tanks 130 and to urge the cutting assembly upward.

Associated with and connected to power modules 84 are a plurality of rotatable cooperating latch members 156 which secure the assembly 16 to sled base 14. These latch members correspond to members 90 of the first embodiment of the invention. The rotatable cooperating member 162 carried by cutting assembly 16, is the female connecting member, the corresponding mating male member 158 being secured to the sled base. Female members 162 are each provided with a cone-shaped guide member to mechanically aid in orienting and aligning the cutting assembly relative to the sled base.

The power modules also contain means (not shown) to rotate driven rotating member 134 mounted on a shaft 170. Each guideline 42 is wound around a corresponding member or drum 134 and is always under tension because, as noted above, the cutting assembly (as did the buoyancy assembly) preferably has a positive buoyancy.

As the cutting assembly is drawn toward the sled base, the stationary fixed, male members 158 on the sled base engage the conical portion of the latch members 162 on the cutting assembly and thereby, the cutting assembly is guided into its operational relationship with the sled base. When the cutting assembly is in that operational relationship, a lever actuated rotatable member (FIG. 9) rotates through an angle of substantially 90° to latch and secure the cutting assembly to the sled base. As before, each rotatable drum 134 of the winch assemblies 40 is preferably locked to provide that extra safety factor in case the latch means, due to an unforeseen circumstance, does not maintain the cutting assembly in its operational relationship with the sled base.

This particular preferred embodiment of the invention also includes a plurality of thrusters 86 (of the type shown in FIG. 2A) for positioning the cutting assembly in a horizontal plane as it is being lowered to or raised from its operational relationship with the sled base. The thrusters provide the assembly with maneuverability in the horizontal plane. Preferably, the thrusters are directed horizontally and number at least four. As in the first embodiment of the invention, the thrusters are responsive to controlling signals from the vessel. Typically, during entrenching operations, the thrusters are not operative and the lifting line 22 attached to the cutting assembly from the vessel is slack.

Referring now to FIG. 9, each power module 84 in each preferred embodiment of the invention houses at least one rotatable latch means member according to the invention for securing the cutting assembly to the sled base (and with respect to the first guideline embodiment, at least one rotatable latch means member for securing the claw portion to the buoyancy assembly). In the several embodiments disclosed herein, each latch means includes a rotatable female member 212 having a conically-shaped guide means 214 extending downward and outward from the power module outer wall 216. The cone-shaped guide means 214 is secured to the outer wall 216 around a circumference, perferably by welding. Each entire rotatable female member 212 is structurally supported by the respective power module of the cutting assembly. Each female member 212 further comprises rotatable means 218 defining a latch pocket 220. Each latch means also includes a cooperating male member 222 (FIG. 10A) fixedly secured to the cross-support structure of the sled base 54, and which, at its uppermost extremity, has an arrow-shaped latch head 226 which fits within latch pocket 220 defined by the rotatable cooperating member 212.

The arrow-shaped head 226 is integrally connected to a member 224 by a shank portion 230 having an outside diameter less than the maximum outside diameter of the arrow-shaped head. The latch pocket 220 has a substantially rectangular cross section 238 at its entrance, the longer dimension being greater than the tip to tip distance of the arrow-shaped head 226, and the shorter dimension being less than the tip to tip distance and greater than the diameter of the shank portion 230. After the arrow-shaped member is engaged in latch pocket 220 (FIG. 10B), the rotatable means 218 defining the latch pocket is rotated about an axis parallel to its longitudinal axis and through an angle of substantially 90°, to lock the male member 222 in place (FIG. 10C).

The rotation of means 218 is effected by a lever activated drive means 240 contained within power module 84 and operated in response to a control signal from the vessel. The drive means 240 comprises a drive motor 242, a connecting rod 244, and a pivotable connection 246 to an arm 248 to effect the rotation of rotatable means 218. Upon being rotated to the locking position, the lower surface 250 of arrow-shaped latch head 226 is engaged by the upper surface 252 of rotatable means 218. This prevents the arrow-shaped member from being removed from the latch pocket.

With respect to the first guide line embodiment, a second latch means is provided wherein the male and female connectors are reversed. The latch pocket is thus secured to the buoyancy assembly and the latching lug is the rotated member, being rotated by drive means 240 on the cutting assembly. This latch means is provided to similarly latch and unlatch the claw portion and the buoyancy assembly to and from each other.

SUMMARY OF THE MAJOR ADVANTAGES OF THE INVENTION

The apparatus and method according to the invention advantageously increase the rate at which an elongated pipeline and the like can be entrenched using the water jetting method. The invention also advantageously provides for a safer operation, with less "down time", and consequently lower overhead costs. The invention also reduces the likelihood of damage to either components of the burying sled or the elongated pipeline.

The invention further advantageously reduces the time needed to reset or reposition the sled assembly in its operational relationship relative to the pipeline.

Other advantages of the invention are a significant reduction in the weight of the sled which must be periodically lifted on board the burying vessel during a pipeline entrenching operation. A further advantage of the invention is a reduction in diver assistance needed to reset the cutting assembly after entrenching has been stopped for routine maintenance or because of bad weather.

A further advantage of the invention is the ability to control, from the vessel, the raising and lowering of the cutting assembly without the need of diver assistance.

Other embodiments of the method and apparatus of the invention including additions, substractions, deletions and other modifications of the described embodiments will be obvious to those skilled in the art and are within the scope of the following claims.

What is claimed is:

1. Apparatus for entrenching an elongated pipeline and the like on the bottom of a body of water comprising a burying sled base, including first and second pontoon skids having generally parallel longitudinal axes, said pontoon skids being connected by a cross support means to straddle said pipeline, a trench cutting assembly adapted to be connected to said sled base for cutting a trench beneath said pipeline, when said pipeline lies on said water bottom, and remote connecting and disconnecting means operative in a first state for remotely connecting said cutting assembly in an operational relationship to said sled base for entrenching said pipeline and in a second state for remotely disconnecting and separating said cutting assembly from said sled base, whereby said sled base may be left on the bottom of said body of water and said cutting assembly may be raised aboard a floating vessel.

2. The apparatus of claim 1 wherein said remote connecting and disconnecting means comprises an electrical umbilical between said vessel and said cutting assembly, a position determining means for providing information to said vessel indicating the position of the cutting assembly relative to the sled base, a latch means controlled from said vessel for securing said cutting assembly to said sled base in said operational relationship and releasing said cutting assembly from said sled base when said cutting assembly is to be removed from said operational relationship with said sled base, and a controlled horizontal positioning means attached to the cutting assembly and responsive to control signals from said vessel for adjusting the position of said cutting assembly in a horizontal plane, and a vertical positioning means carried by the vessel, for changing the position of the cutting assembly in a vertical direction, said vertical means including a support means extending from said floating vessel to the cutting assembly, said vertical means in said first state, effecting controlled lowering of said cutting assembly to substantially the bottom of the body of water, and in the second state, effecting controlled raising of said cutting assembly from substantially the bottom of said body of water.

3. The apparatus of claim 2 wherein said remote connecting and disconnecting means further comprises a control means operable in response to said information for controlling said latch means, said horizontal means, and said vertical means for remotely positioning and securing the cutting assembly in said operational relationship with the sled base.

4. The apparatus of claim 2 wherein said position determining means includes a sonar transmitter and receiver and a television camera transmitter and receiver.

5. The apparatus of claim 2 wherein said horizontal positioning means comprises a plurality of horizontally directed thrusters.

6. The apparatus of claim 5 wherein the number of thrusters is at least four and associated pairs of said thrusters are directed at right angles to each other.

7. The apparatus of claim 2 wherein said support means comprises a support means connected between said cutting assembly and a winch assembly on board said vessel and said cutting assembly further includes a buoyancy means for at least partially neutralizing the weight of said cutting assembly in water.

8. The apparatus of claim 2 wherein said latch means includes a plurality of remotely controlled interlocking member pairs, each member pair including first and second cooperating members, one member on said sled base and one member on said cutting assembly, and means remotely controlled from said vessel to rotate one of said cooperating members through an angle of substantially 90°.

9. The apparatus of claim 8 wherein said rotatable cooperating member is on the cutting assembly.

10. The apparatus of claim 2 further including mechanical guide means for guiding said cutting assembly into said operational relationship with said sled base.

11. Apparatus for entrenching an elongated pipeline and the like on the bottom of a body of water comprising a burying sled base, said sled base having first and second pontoon skids, said skids having generally parallel longitudinal axes, said skids being connected by a cross support means to straddle said pipeline, a trench cutting assembly for cutting a trench beneath said pipeline while the pipeline lies on the bottom of said body of water, an umbilical between a floating vessel and said cutting assembly, said cutting assembly including a plurality of horizontally directed thrusters attached thereto and responsive to a horizontal control signal from said vessel for adjusting the horizontal position of the cutting assembly in said body of water, said cutting assembly including a buoyancy means for at least partially neutralizing the weight of said cutting assembly, means for providing information to the vessel indicating the position of the cutting assembly relative to the sled base, said information means including a sonar transmitter and receiver and a television camera transmitter and receiver, a vertical positioning means for changing the position of the cutting assembly in a vertical direction, the vertical positioning means including a support means connected between the cutting assembly and a winch assembly on board said vessel for effecting controlled lowering of the cutting assembly to the bottom of said body of water in a first state, and for effecting controlled raising of said cutting assembly from the bottom of said body of water in a second state, a mechanical guide means for guiding said cutting assembly into said operational relationship with said sled base, a plurality of remotely controlled interlocking member pairs for securing the cutting assembly to the sled base in an operational relationship and for releasing the cutting assembly from the sled base when the cutting assembly is to be removed from the operational relationship with the sled base, each member pair including first and second cooperating members, said first member on the sled base and said second member on the cutting assembly, and means on said cutting assembly and controlled from the vessel to rotate said second cooperating member through an angle of substantially 90°.

12. The apparatus of claim 1 wherein said remote connecting and disconnecting means comprises an electrical umbilical between said vessel and said cutting assembly, at least one guideline and at least one driven rotating member, each guideline extending from a different one of said driven rotating members between said cutting assembly and said sled base, each said guideline at one end being secured to said sled base and at the other end to said driven rotating member, a remotely controlled drive means for rotating each said rotating member in response to a control signal from said vessel, and a buoyancy means secured to and forming a part of said cutting assembly, said buoyancy means having at least one state wherein the net buoyancy of the cutting assembly urges the cutting assembly upward, whereby said cutting assembly can be remotely lowered into an operational relationship to said sled base by controlling said drive means.

13. The apparatus of claim 12 wherein there are at least two guidelines and at least two driven rotating members.

14. The apparatus of claim 13 including means for lowering the cutting assembly from the vessel and for lifting said cutting assembly onto said vessel.

15. The apparatus of claim 12 wherein said remote connecting means further comprises position determining means for providing information to said vessel indicating the position of the cutting assembly relative to the sled base, and latch means controlled from said vessel for securing said cutting assembly to said sled base in said operational relationship and for releasing said cutting assembly from said sled base when said cutting assembly is to be removed from said operational relationship with the sled base.

16. The apparatus of claim 15 wherein said position determining means includes a television camera transmitting and receiving means, said transmitting means being secured to said cutting assembly and said receiving means being aboard said vessel.

17. The apparatus of claim 15 wherein said latch means includes a plurality of remotely controlled interlocking member pairs, each member pair including first and second cooperating members, one member on said sled base and one member on said cutting assembly, and means controlled from said vessel to rotate one said cooperating member through an angle of substantially 90°.

18. The apparatus of claim 17 wherein said rotatable cooperating member is on said cutting assembly.

19. The apparatus of claim 12 including means responsive to a control signal from said vessel to vary the buoyancy of said buoyancy means.

20. The apparatus of claim 12 wherein said buoyancy means has a fixed buoyancy.

21. The apparatus of claim 12 further including mechanical guide means for guiding said cutting assembly into said operational relationship with said sled base.

22. Apparatus for entrenching an elongated pipeline and the like on the bottom of a body of water comprising a burying sled base, the sled base having first and second pontoon skids, the skids having generally parallel longitudinal axes, the skids being connected by a cross-support means to straddle the pipeline, a trench cutting assembly for cutting a trench beneath the pipeline while the pipeline is on the bottom of said body of water, an electrical umbilical between the cutting assembly and a vessel, the cutting assembly including a plurality of horizontally directed thrusters attached thereto and responsive to a horizontal control signal from the vessel for adjusting the horizontal position of the cutting assembly in said body of water, the cutting assembly further including a buoyancy means secured to and forming a part of the cutting assembly, the buoyancy means having a state wherein the net buoyancy of the cutting assembly is fixed and urges the cutting assembly upwards, means for providing information to the vessel indicating the position of the cutting assembly relative to the sled base, the means including a television camera transmitting and receiving means, the transmitting means being carried by the cutting assembly and the receiving means being carried by said vessel, a vertical positioning means responsive to a control signal from the vessel for changing the position of the cutting assembly in a vertical plane, the vertical means including a plurality of guidelines and a plurality of driven rotating members carried by the cutting assembly, each guideline extending from a different one of said driven rotating members to the sled base, the guideline at one end, being secured to the sled base, and at the other end, to the driven rotating member, remotely controlled drive means for rotating each said rotating member in response to an output signal from the vessel, a plurality of remotely controlled interlocking member pairs for securing the cutting assembly to the sled base in an operational relationship and releasing the cutting assembly from the sled base when the operational relationship is to be no longer maintained, each member pair including first and second cooperating members, said first member on the sled base and said second member on the cutting assembly, and means remotely controlled from the vessel to rotate the second cooperating member through an angle of substantially 90°.

23. The apparatus of claim 1 wherein said remote connecting and disconnecting means comprises an electrical umbilical between the cutting assembly and the vessel, at least one guideline, a buoyancy assembly, said buoyancy assembly including a buoyancy means, said buoyancy means having at least one state wherein the buoyancy assembly has a positive buoyancy for urging the buoyancy assembly upwards, at least one driven rotating member, each guideline extending from a different one of said driven rotating members to said sled base, each said guideline at one end being secured to said sled base and at the other end to the respective driven rotating member of said buoyancy assembly, and means responsive to a control signal from the vessel for operating said rotating members, first latch means responsive to a signal from said vessel for securing a cutting means to said buoyancy assembly in a cutting assembly operational relationship and for releasing said cutting means from said buoyancy assembly when the cutting means is to be removed from said cutting assembly operational relationship, said cutting means and said buoyancy assembly together comprising said trench cutting assembly, and whereby said cutting means and buoyancy assembly can be remotely lowered to an operational relationship with said sled base by the operation of the driven rotating members.

24. The apparatus of claim 23 wherein there are at least two guidelines and at least two driven rotating members.

25. The apparatus of claim 23 wherein said remote connecting and disconnecting means further comprises a position determining means for providing information to the vessel indicating the position of the cutting assembly relative to the sled base, and a second latch means controlled by means on board the vessel for securing said cutting assembly to said sled base in said operational relationship and for releasing said cutting assembly from said sled base when the cutting assembly is to be removed from said operational relationship with said sled base.

26. The apparatus of claim 25 wherein said remote means further includes remotely controlled horizontal positioning means attached to the cutting assembly and responsive to a signal from the vessel for adjusting the horizontal position of said cutting assembly in said body of water.

27. The apparatus of claim 26 wherein said horizontal positioning means comprises a plurality of horizontally directed thrusters.

28. The apparatus of claim 27 wherein the number of thrusters is at least four.

29. The apparatus of claim 25 wherein said position determining means includes television camera transmitting and receiving means, said transmitting means being secured to said cutting assembly and said receiving means being aboard said vessel.

30. The apparatus of claim 25 wherein said second latch means includes a plurality of remotely controlled interlocking member pairs, each member pair including first and second cooperating members, one member on said sled base and one member on said cutting assembly, and remotely controlled means responsive to a control signal from the vessel to rotate one of said cooperating members through an angle of substantially 90°.

31. The apparatus of claim 30 wherein said rotatable cooperating member is on said cutting assembly.

32. The apparatus of claim 23 further including mechanical guide means for guiding said cutting assembly into said operational relationship with said sled base.

33. Apparatus for entrenching an elongated pipeline and the like on the bottom of a body of water comprising a burying sled base, said sled base having first and second pontoon skids, said skids having generally parallel longitudinal axes, said skids being connected to a cross-support means to straddle said pipeline, a trench cutting assembly for cutting a trench beneath said pipeline while the pipeline lies on the bottom of a body of water, said cutting assembly having a buoyancy assembly and a cutting means, an electrical umbilical between the cutting assembly and a vessel, said cutting assembly including a plurality of horizontally directed thrusters attached to the cutting assembly and responsive to a horizontal control signal from said vessel for adjusting the horizontal position of the cutting assembly in the body of water, at least two guidelines, said buoyancy assembly including a buoyancy means having a fixed buoyancy to provide said cutting assembly with a net positive buoyancy, at least two driven rotating members, each guideline extending from a different one of said driven rotating members to said sled base, each said guideline at one end being secured to said sled base and at the other end to said driven rotating members, means responsive to a remotely generated rotation control signal from said vessel for operating said rotating members, first latch means responsive to a latch control signal from said vessel, for securing said cutting means to the buoyancy assembly in a second operational relationship and for releasing said cutting means from said buoyancy assembly when the cutting means is to be removed from said second operational relationship, means for providing information to the vessel indicating the position of the cutting assembly relative to the sled base, said means including a television camera transmitting and receiving means, a plurality of remotely controlled interlocking member pairs for securing the cutting assembly to the sled base in the operational relationship and releasing the cutting assembly from the sled base when the cutting assembly is to be removed from the operational relationship with the sled base, each member pair including first and second cooperating portions, one portion on the sled base and one portion on the cutting assembly, and means responsive to a signal from said vessel to rotate one said cooperating portion through an angle of substantially 90°.

34. A method for entrenching an elongated pipeline and the like on the bottom of a body of water comprising the steps of placing a burying sled having a burying sled base and a trench cutting assembly at the bottom of said body of water in an operational relationship to said pipeline wherein said sled straddles said pipeline and said cutting assembly is connected to said sled base, pulling said sled base and trench cutting assembly along said pipeline to entrench said pipeline, remotely unlatching said trench cutting assembly from said sled base, remotely raising and removing said trench cutting assembly from its operational relationship with said sled base, leaving said sled base on the bottom of said body of water, remotely lowering the trench cutting assembly to an operational relationship with said sled base and said pipeline, and remotely securing said cutting trench assembly to said sled base in said operational relationship.

35. The method of claim 34 for entrenching an elongated pipeline including the steps of locating the position of said trench cutting assembly relative to said sled base to aid in lowering and securing said cutting assembly to said sled base and providing guide means for guiding said trench cutting assembly into said operational relationship with said sled base.

36. The method of claim 34 for entrenching an elongated pipeline including the step of providing at least two guidelines from said sled base to said trench cutting assembly to aid in said lowering and raising steps.

37. The method of claim 36 for entrenching an elongated pipeline including the steps of providing a trench cutting assembly having a cutting means and a buoyancy assembly detaching said cutting means from said buoyancy assembly, removing said cutting means from said body of water, and leaving said buoyancy assembly beneath a wave action depth of said body of water.

38. The method of claim 36 for entrenching an elongated pipeline including the step of removing said trench cutting assembly from said body of water.

39. The method of claim 36 including the steps of detaching said guidelines from said trench cutting assembly after said raising and removing step, attaching float means to said detached guidelines, and placing said guidelines and float means into said water, whereby said float means marks the position of said guidelines for later pickup.

* * * * *